US005306178A

United States Patent [19]

Huang

[11] Patent Number: 5,306,178

[45] Date of Patent: Apr. 26, 1994

[54] PHONE JACK BOX

[76] Inventor: Min Huang, No. 38, Lane 21, Section 2, Chin Hwa Road, Tainan, Taiwan

[21] Appl. No.: 95,009

[22] Filed: Jul. 23, 1993

[51] Int. Cl.[5] ..... H01R 13/52

[52] U.S. Cl. ..... 439/536; 174/67; 439/142

[58] Field of Search ..... 439/536, 142, 535, 537, 439/538; 174/57, 67

[56] References Cited

U.S. PATENT DOCUMENTS

| | | | |
|---|---|---|---|
| 3,106,602 | 10/1963 | Hartz | 439/142 |
| 4,058,358 | 11/1977 | Carlisle | 439/142 |
| 4,342,493 | 8/1982 | Grenell | 439/142 |
| 4,505,403 | 3/1985 | Bowden, Jr. et al. | 174/67 |
| 4,794,207 | 12/1988 | Norberg et al. | 439/535 |
| 4,874,906 | 10/1989 | Shotey | 174/67 |
| 4,899,019 | 2/1990 | Riceman | 174/67 |
| 5,148,348 | 9/1992 | White | 174/67 |
| 5,228,869 | 7/1993 | Below | 439/536 |

*Primary Examiner*—Gary F. Paumen

*Attorney, Agent, or Firm*—Morton J. Rosenberg; David I. Klein

[57] ABSTRACT

A phone jack box consisting of an enclosure adapted to receive phone jack terminals therein, and a wall plate clampingly engaged to a front frame portion of the enclosure in a secure manner is provided. The wall plate includes at least one wire cord outlet which is covered with a lid.

1 Claim, 4 Drawing Sheets

PHONE JACK BOX

BACKGROUND OF THE INVENTION

1. Field of the Invention

This invention relates to a phone jack box. More particularly, this invention is directed to a box that is able to provide protection from dust and water getting therein, and protects against children getting electric shocks.

2. Prior Art

In a modern family home, telephone jacks are installed in almost every room and even on the patio, for the convenience of people. A phone jack box is generally composed of a receptacle A and a wall plate B, as shown in FIG. 4. The receptacle A has jack terminals A1 disposed centrally, four apertures A2, at each corner, and a pair of holes A3 at opposing respective ends. The wall plate B includes a centrally located square aperture B1 adapted to provide access to the phone outlet jack of the receptacle A. The wall plate also includes four clamps B2 disposed at each of the four corners adapted to hold the wall plate B to the receptacle A by engagement therewith through the respective apertures A2. The receptacle A and the wall plate B, then are inserted into a wall box C with screws through the holes A3.

However, these phone jack boxes cannot prevent dampness from entering and having an influence on communication quality. Rain or water may get into the receptacle A and cause an electrical short circuit.

SUMMARY OF THE INVENTION

It is the primary object of the present invention to provide a phone jack box which seals the phone jack box securely to protect the interior of the box from becoming damp.

It is another object of the present invention to provide a phone jack box which includes a weatherproof cap to prevent dust or water from getting therein.

It is a further object of the present invention to provide a phone jack box which is easy to install.

It is still a further object of the present invention to provide a phone jack box which is inexpensive to produce.

DETAILED DESCRIPTION OF THE PREFERRED EMBODIMENT

Figure 1:
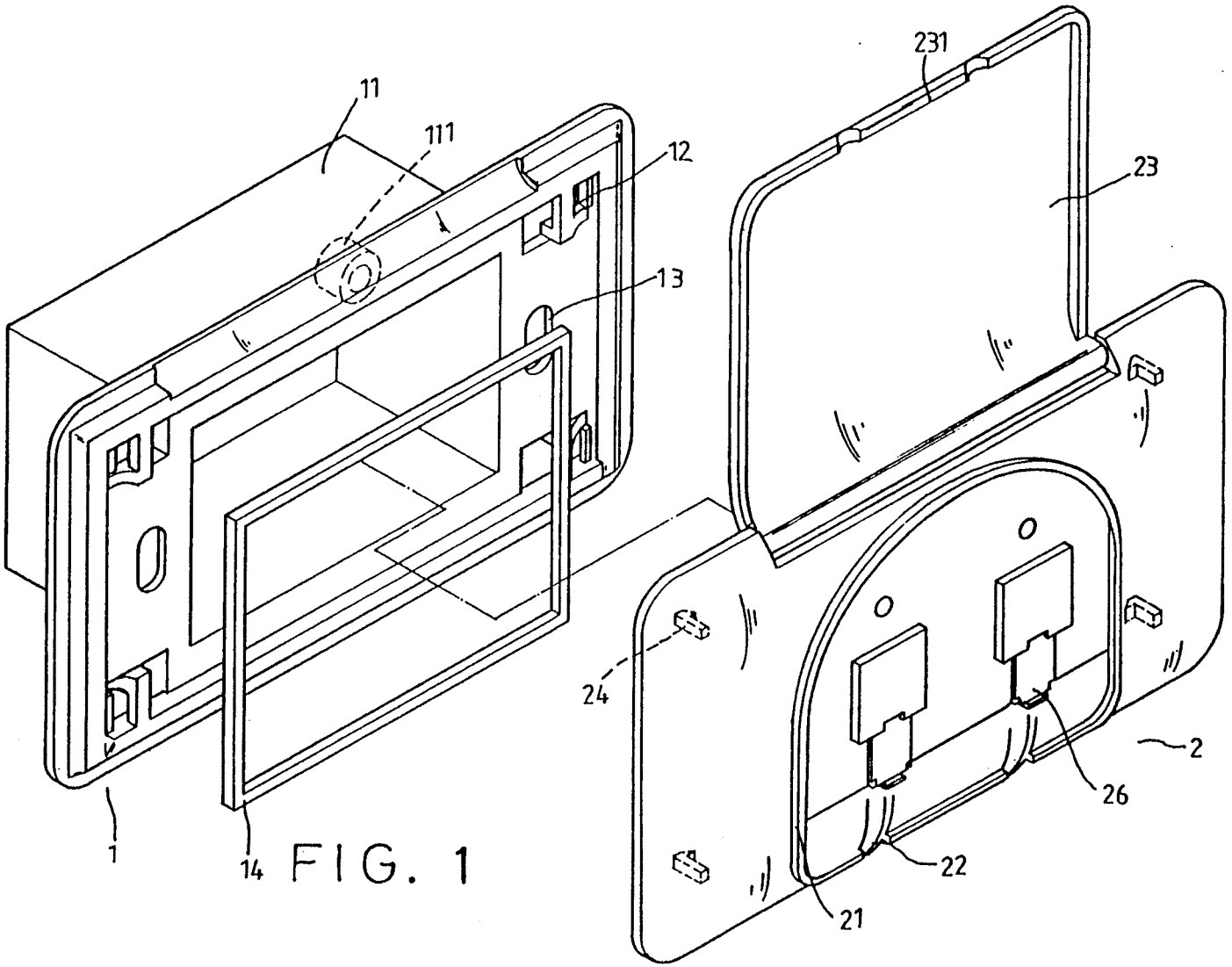
FIG. 1 is an exploded view of the present invention.
Figure 2:
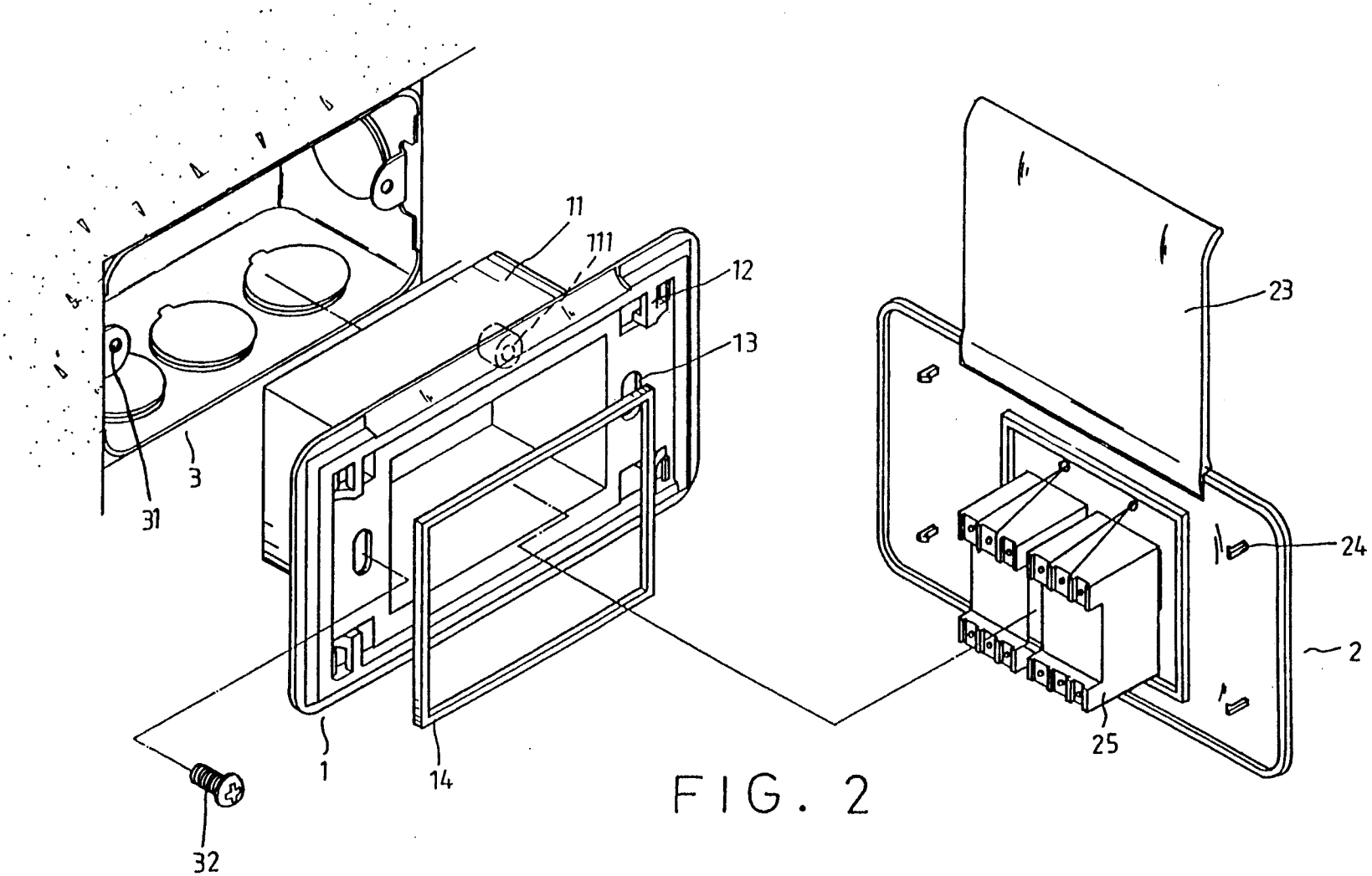
FIG. 2 is another exploded view of the present invention.
Figure 3:
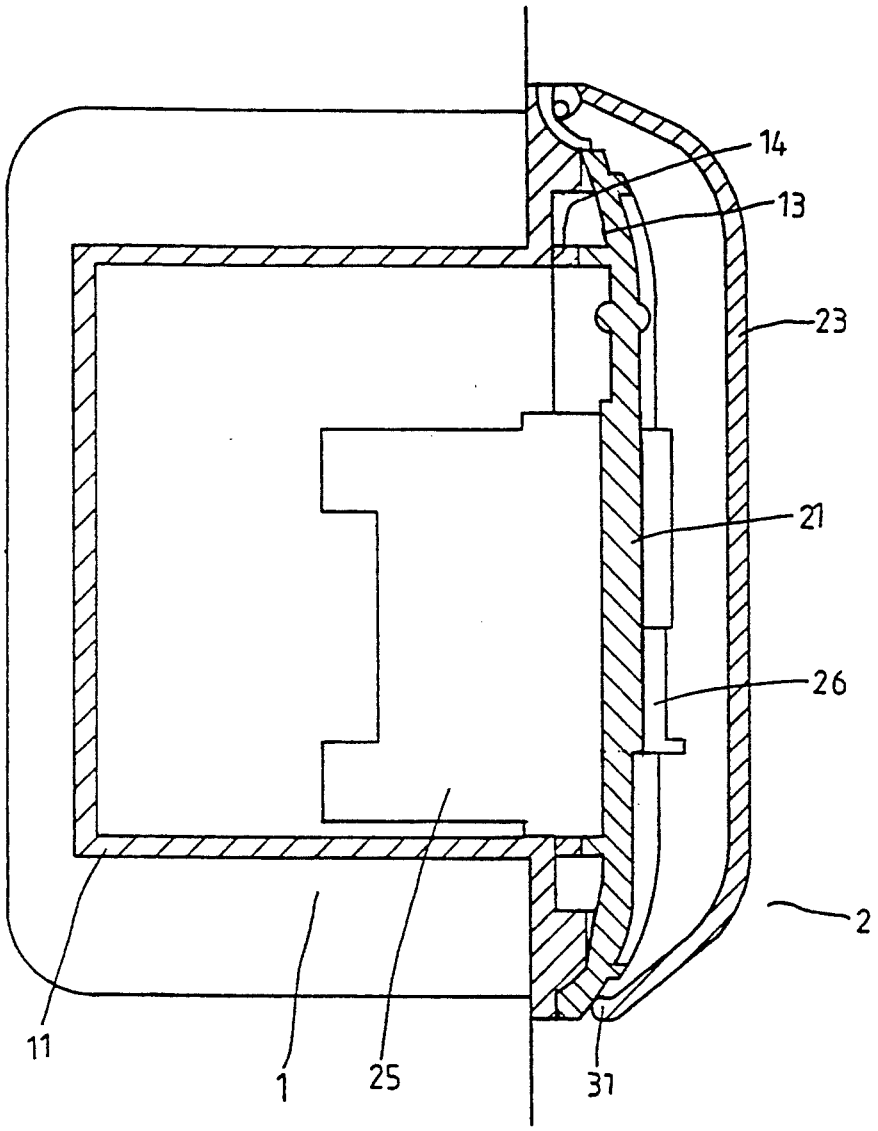
FIG. 3 is a partially sectioned side view of FIG. 1.
Figure 4:
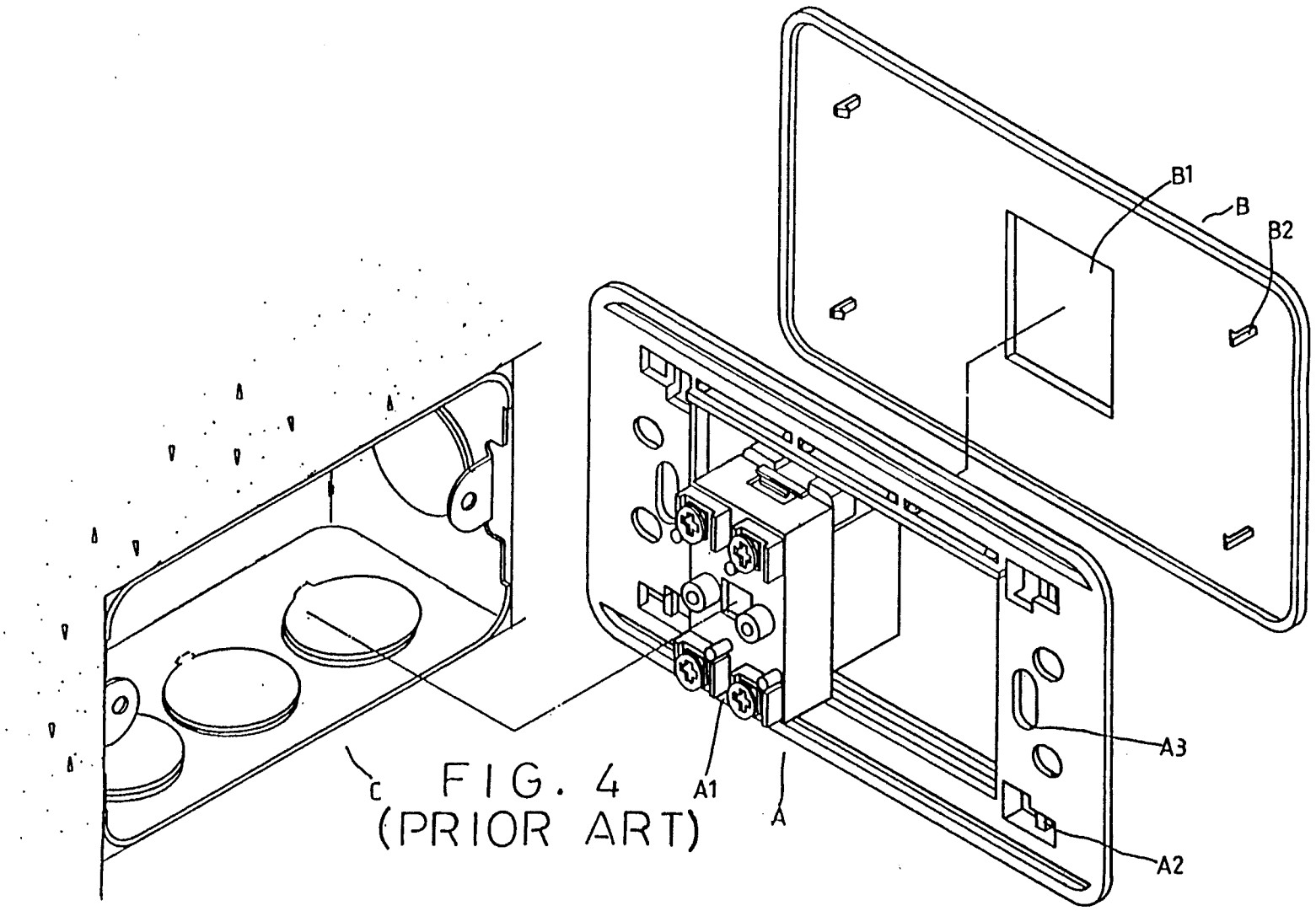
FIG. 4 (PRIOR ART)
FIG. 4 is an exploded view of a prior art phone jack box.

Referring now to the drawings, provided for the purpose of illustrating a preferred embodiment and not for the purpose of limiting the same, FIGS. 1 and 2 are exploded views of the present invention which includes a jack box 1, a wall plate 2, and a wall box 3.

The jack box 1 has an enclosure 11 extending from a rear surface of a frontal frame portion, adapted to receive telephone wire and having an open cavity. The cavity is open at the front and closed at the rear end thereof. Four apertures 12 are formed at each of the four corners of the frontal frame portion, and a pair of holes 13 are formed at respective sides thereof. A feed hole 111 if formed in the wall of the rectangularly shaped enclosure 11 for wire to be inserted therethrough. A gasket 14 is provided to prevent water from entering the enclosure.

The wall plate 2 has a protruding rib 21 surrounding two closures 26. Each closure 26 covers a respective one of the two receptacles coupled to wall plate 2. A pair of recesses 22 are formed in wall plate 2, each of the recesses 22 being disposed beneath a respective one of the two closures 26 for receiving a wire cord therein. A cover 23 is hingedly coupled to the top portion of wall plate 2. Lid 23 has a flanged leading edge 231 adapted to releasably engage the rib 21. Four studs 24 extend from the rear surface of wall plate 2, each of the studs is disposed at a respective one of the four corners for clamping engagement with the jack box 1 through the apertures 12. Jack terminals 25 are provided at the back side of the receptacles coupled to plate 2 for providing electrical connections thereto.

The wall box 3 is disposed within an opening formed in the dry wall panel of a building structure. The wall box 3 includes a pair of lugs extending from respective sides thereof having female threaded holes 31 for securing the jack box 1 thereto, with screws 32 (one shown) passing through the holes 13.

To assemble the present invention, first the wire cord from the wire feed of the box 3 is pulled out and inserted through the feed hole 111 of the jack box 1. The jack box 21 is then inserted into the wall box 3 and secured thereto with screws 32. Subsequently, the feed hole 111 should be sealed with silicon to prevent water from entering the jack box 1. The wire is then connected to the terminals 25 and the wall plate 2 is engaged to the jack box 1 by means of the studs 24 which clampingly engage the jack box 1 through the apertures 12. The gasket 14 seals the interface between the jack box 1 and the wall plate 2, such that no water or dust can enter the jack box through that interface. The rib 21 acts like a gutter, guiding any water either from rain or other sources away from the receptacle access openings behind closures 26 for draining the water to the ground and avoiding any short circuits.

I claim:

1. A phone jack box for securement to an electrical wiring box, comprising:

at least one telephone receptacle;

a housing, said housing having a frontal frame portion and an enclosed portion extending from a rear surface of said frontal frame portion, said enclosed portion defining a cavity therein, said cavity being closed at a rear end thereof and in open communication with a respective aperture formed through said frontal frame portion for receipt of at least a portion of said receptacle therein, said enclosed portion having a wire access opening formed through one wall thereof, said frontal frame having a plurality of through openings formed therethrough, at least two of said plurality of through openings being disposed on opposing sides of said aperture and in alignment with respective openings in said electrical wiring box for said securement thereto with a respective pair of threaded fasteners;

a wall plate member secured to said frontal frame portion of said housing, said wall plate member having four studs extending from a rear surface thereof for clampingly engaging said frontal frame portion through a respective four of said plurality of through openings formed in said frontal frame portion, said receptacle being coupled to said wall plate member and accessible through a respective aperture formed through said wall plate member, said wall plate member having a displaceable closure for said receptacle access aperture disposed on a front surface thereof, said wall plate member having an elongated rib protruding from said front surface thereof and substantially circumscribing said receptacle access aperture;

a cover member hingedly coupled to said front surface of said wall plate member, said cover member having a lip portion extending about a perimeter edge thereof for releasable engagement with said elongated rib; and, a gasket member disposed between said frontal frame portion of said housing and said rear surface of said wall plate member for providing a moisture and dust seal thereat.

* * * * *